US009126090B1

(12) United States Patent
Watson

(10) Patent No.: US 9,126,090 B1
(45) Date of Patent: Sep. 8, 2015

(54) GOLF VISUAL TRAINING AID AND FEEDBACK DEVICE

(71) Applicant: Edward Bates Watson, Long Beach, CA (US)

(72) Inventor: Edward Bates Watson, Long Beach, CA (US)

( * ) Notice: Subject to any disclaimer, the term of this patent is extended or adjusted under 35 U.S.C. 154(b) by 0 days.

(21) Appl. No.: 14/447,032

(22) Filed: Jul. 30, 2014

(51) Int. Cl.
*A63B 69/36* (2006.01)
*A63B 69/00* (2006.01)

(52) U.S. Cl.
CPC ..... *A63B 69/3632* (2013.01); *A63B 69/0057* (2013.01); *A63B 69/0059* (2013.01); *A63B 69/3608* (2013.01)

(58) Field of Classification Search
CPC ..... A63B 69/3632; A63B 69/0057
USPC ..... 473/215, 227, 257
See application file for complete search history.

(56) References Cited

U.S. PATENT DOCUMENTS 6,872,149 B1 * 3/2005 Devon ..... 473/231
2002/0173368 A1 * 11/2002 Lane ..... 473/215

* cited by examiner

*Primary Examiner* — Nini Legesse

(57) ABSTRACT

A visual reference and feedback device for use with a golf club is presented. The visual reference and feedback device includes a clubface reference head and a neck that connects a supporting body to the clubface reference head. The supporting body includes three supporting members having a first supporting member, a second supporting member, and a third supporting member. C-clip fasteners may be formed at distal ends of the first supporting member and second supporting member. A sternum guide may be formed as a rectangular structure at the outer portion of the first supporting member and proximate to the neck of the visual aid and feedback device.

17 Claims, 13 Drawing Sheets

GOLF VISUAL TRAINING AID AND FEEDBACK DEVICE

FIELD OF THE INVENTION

The present invention relates to golf training aid devices. In particular, the present invention relates to golf training aid devices having a visual reference and feedback for use with a golf club.

BACKGROUND

Several conventional golf training aid devices exist for helping a golfer improve their golf swing, thereby improving the stability and accuracy of the golfer's swing. Some of these training aid devices are designed to be attached to golf clubs, while other devices may be worn by the golfer.

Existing golf training aid devices include motion restricting or limiting devices such as, for example, tools that attach to the ends of club grips that guide the hands to be in the proper position, devices that attach to the club grip that sets the wrists during the swing, and clothing that is worn by the golfer's that restricts the golfer's arms to a set position and range of motion. Most of these golf training aid devices generally assist the golfer in improving their accuracy by restricting the movement of the golfer's arms, wrist or hands thereby reducing the golfer's swing variation.

Although these golf training devices may benefit the golfer's posture and swing alignment, other forms of training devices may be beneficial for improving the golfer's swing.

SUMMARY

It is an advantage of the present invention to provide a visual aid and feedback device including a clubface reference head and a neck that connects a supporting body to the clubface reference head.

It is another advantage of the present invention to provide c-clip fasteners formed on the visual aid and feedback device. The c-clips may fit and attach to the grip of the golf club by inserting and snapping the opening of the c-clip directly onto the grip, making it a simple and convenient way to fasten or unfasten the visual aid and feedback device from the grip of the golf club.

It is yet another advantage of the present invention to provide a sternum guide that is formed as a rectangular structure at the outer portion of the first supporting member and proximate to the neck of the visual aid and feedback device.

It is no less another advantage of the present invention to provide various wrist guide designs where each wrist guide design is formed adjacent to the sternum guide and may rest on the inside wrist of the golfer to ensure that the clubface stays in the correct position through the swing of the golfer.

These and other objects, features and advantages of the present invention will become more apparent in light of the following detailed description of preferred embodiments thereof, as illustrated in the accompanying drawings.

BRIEF DESCRIPTION OF THE DRAWINGS

The present invention will be more clearly understood from the following detailed description of the preferred embodiments of the invention and from the attached drawings, in which.

In the appended figures, the same reference numerals may be used in the figures to indicate like features or elements.

DETAILED DESCRIPTION

Properly orientating and positioning a golf club can be challenging and difficult for many golfers. In a typical golf club design, the main parts of the golf club include a grip, a shaft, and a head. The head of the golf club has two sides known as a clubface and a back. In practice, the ideal is to get the clubface to a golf ball perpendicular at impact. With respect to the clubface, it may be difficult to set the proper orientation of the clubface based on the golfer's grip positioning and stance at address position.

Figure 1:
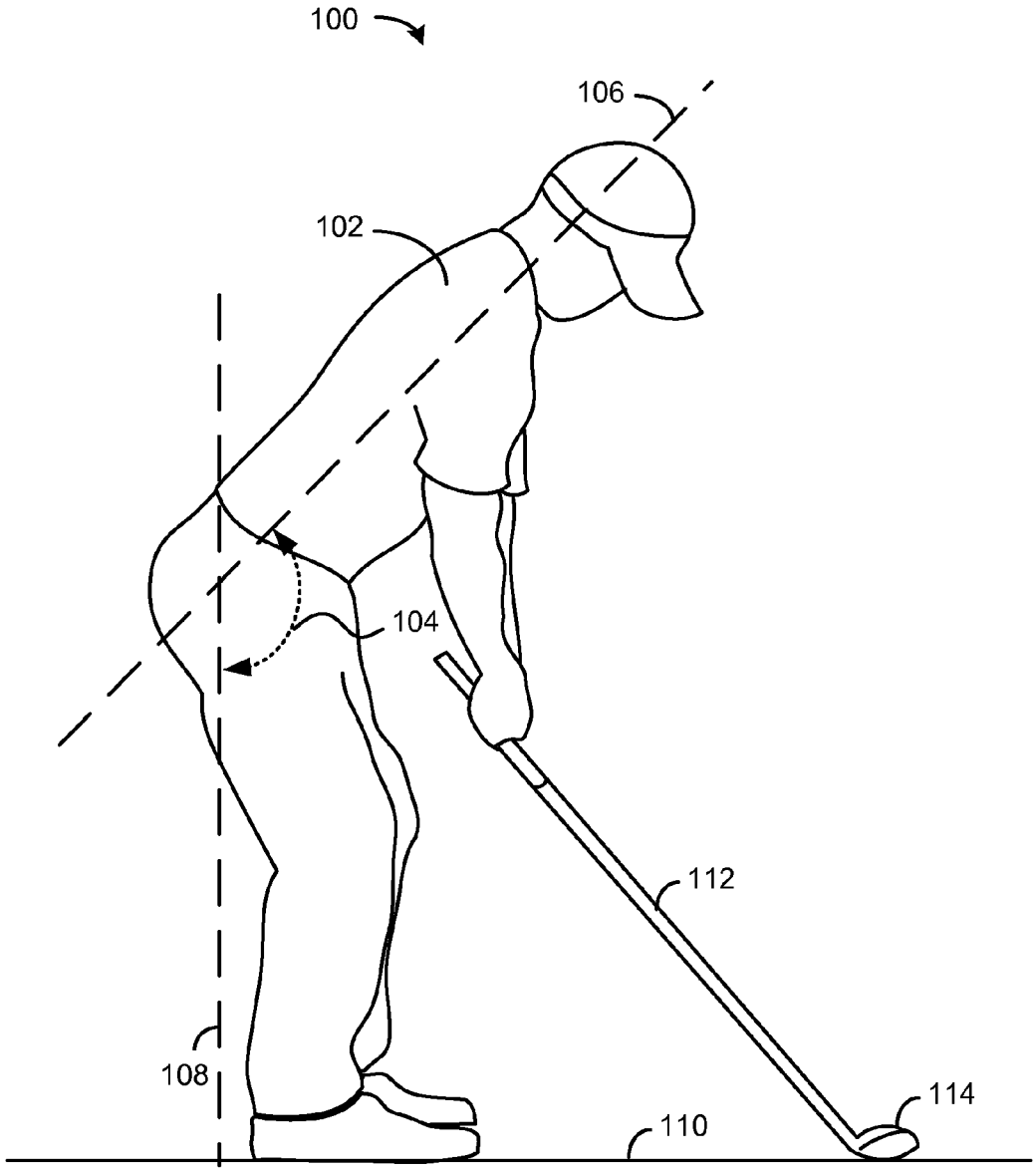
FIG. 1 illustrates a posture and alignment of a golfer gripping a golf club at address position.

Maintaining a proper grip is generally achieved by rotating the clubface to match the orientation of the golfer's torso or spine angle. FIG. 1 illustrates, for example, a golfer 100 having a spine angle 102 defined by an angle formed between the golfer's torso 104 and a perpendicular line 106 relative to the ground 108. The golfer 100 may adjust their spine angle 102 orientation by slightly bending their torso in a forward manner, thereby decreasing the amount of spine angle 102. Thus, with respect to the golfer's spine angle 102, the proper grip orientation of a golf club 110 may be formed when a clubface 112 of the golf club 110 is oriented to closely match the spine angle 102 of the golfer 100.

Figure 2:
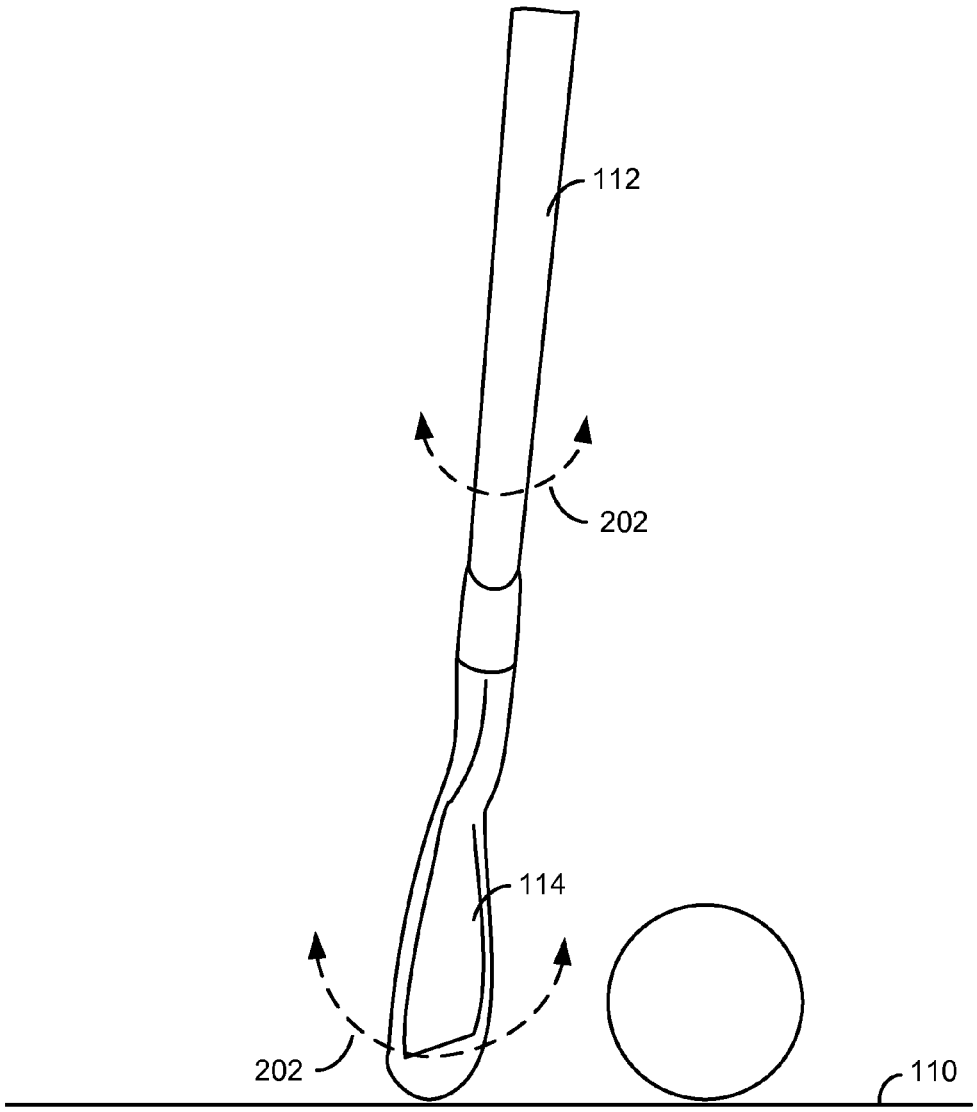
FIG. 2 illustrates a front facing view of the golf club and clubface of FIG. 1.

FIG. 2 illustrates a front facing view of the golf club 110 and clubface 112 of FIG. 1. In this illustration, an angular orientation of the clubface 112 follows the grip orientation of the golfer 100 by rotating the golf club 110 in a clockwise or counter-clockwise manner 202. In practice, the golfer 100 may strike a golf ball 204 using different grip orientations thereby changing the angular orientations of the clubface 112 resulting in various trajectories and paths of the golf ball 204. Preferably, a method for achieving proper control of the trajectory and path of the golf ball 204 is obtained by adjusting the grip orientation of a golf club 110 so that the clubface 112 of the golf club 110 is oriented to closely match the spine angle 102 of the golfer 100. A visual aid and feedback device described herein below may provide and assist the golfer 100 using visual and tactile feedback for achieving the proper grip orientation.

Figure 3:
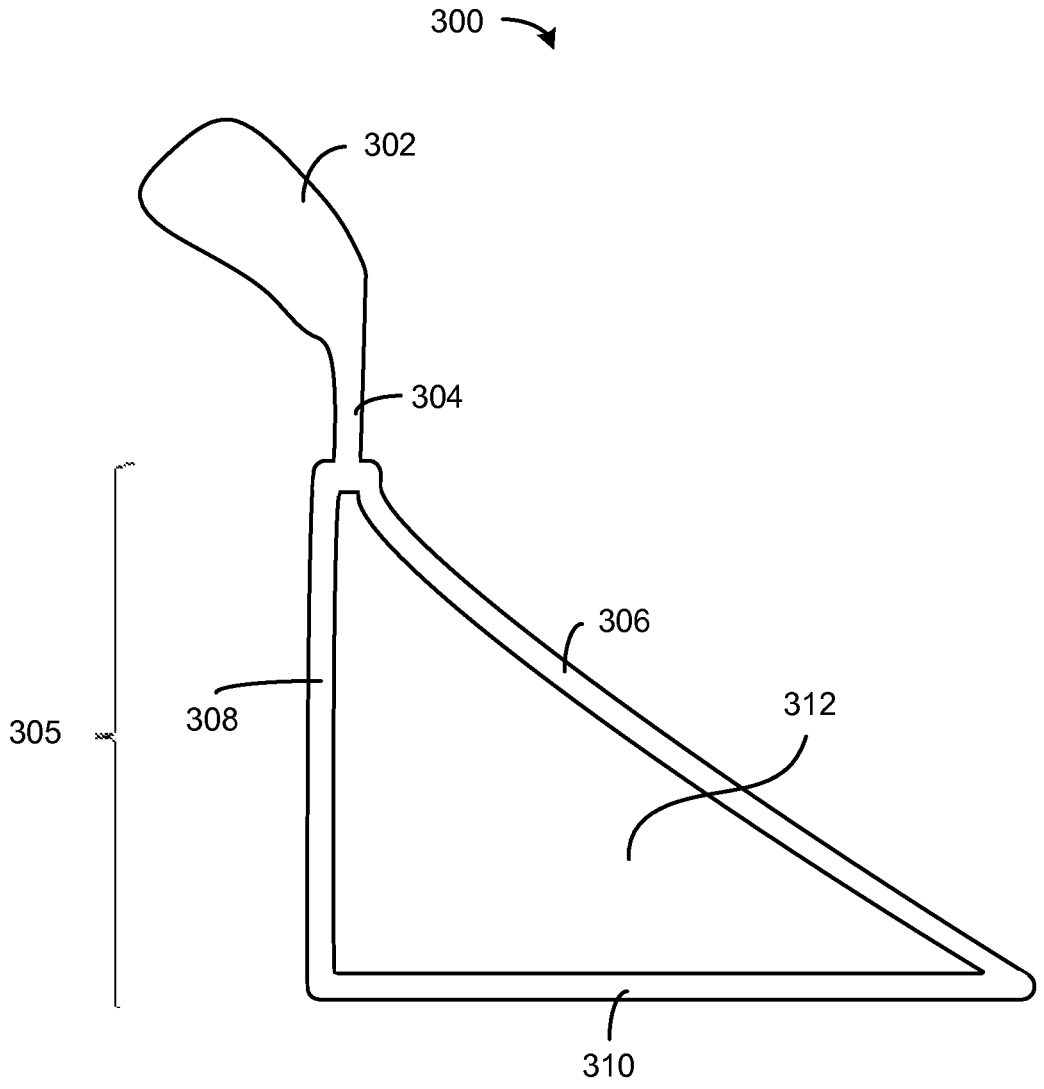
FIG. 3 illustrates a visual aid and feedback device for properly orienting and positioning the clubface of the golf club shown in FIG. 1 in accordance with an embodiment.

FIG. 3 illustrates a first embodiment of a visual aid and feedback device 300 for properly orienting and positioning the clubface of the golf club shown in FIG. 1. The visual aid and feedback device 300 includes a clubface reference head 302 and a neck 304 (or narrow connector) that connects a supporting body 305 to the clubface reference head 302. The clubface reference head 302 may include various golf club designs to match a particular head of the golf club in use. The clubface reference head 302 may also be detachable from neck 304 via a fastener, such as a quick disconnect or bolt and threaded screw design, so that other golf club head designs may be used. The supporting body 305, as shown in this embodiment, includes three supporting members (306, 308, and 310) that is generally in the form of a right triangle having a first supporting member 306 at the hypotenuse side of the triangle, a second supporting member 308 at the perpendicular side (or opposite side) of the triangle, and a third supporting member 310 at the adjacent side 210 of the right triangle. The three supporting members (306, 308, and 310) forms an inner opening 312 that is designed to be large enough to fit one hand of the golfer without interfering with the golfer's swing. Other shapes of the supporting body 305 may include but is not limited to, for example, a rectangular body, other triangular shapes such as is equilateral, isosceles, and scalene triangular shapes, and other polygon shapes.

The visual aid and feedback device 300 is also designed to be lightweight and have a conformable grip so that it may reduce any interference with the golfer's grip position or swing. Injection molding processes, for example, may be used to fabricate the visual aid and feedback device 300 as a single integrated structure using thermoplastics or other molding forming plastics to form a lightweight yet durable part at high production output rates.

Figure 4:
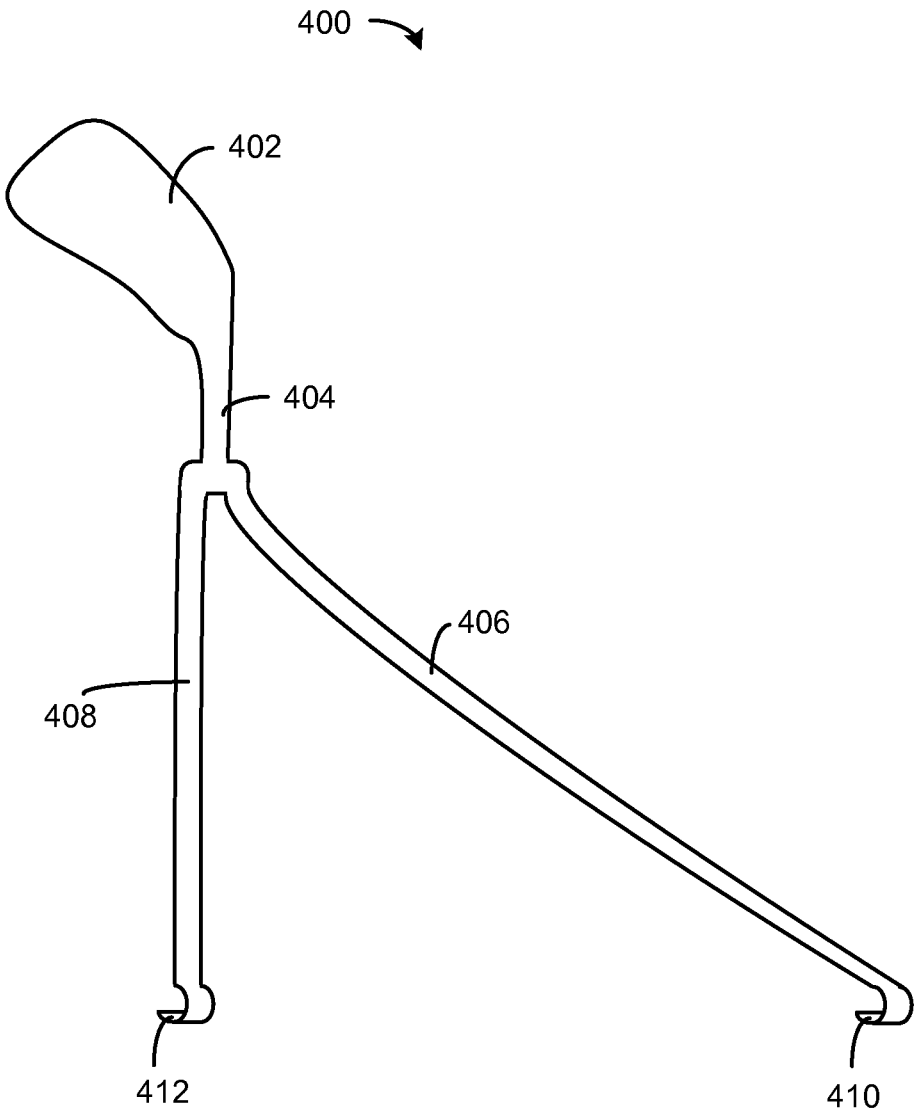
FIG. 4 illustrates a visual aid and feedback device implementing c-clip fasteners in accordance with an embodiment.

FIG. 4 illustrates a second embodiment of a visual aid and feedback device 400. The visual aid and feedback device 400, like the visual aid and feedback device 300 of the first embodiment, includes a clubface reference head 402, a neck 404 (or narrow connector), a first supporting member 406 and a second supporting member 408 which generally perform the same function as described in the device 300 of the first embodiment. For example, like the first embodiment, the clubface reference head 402 in the second embodiment may be detachable from neck 404 using a fastener so that other golf club head designs may be used.

In FIG. 4, c-clips (410, 412) are formed at distal ends of the first supporting member 406 and second supporting member 408, respectively. The c-clips are designed to fit and attach to the grip of the golf club by inserting and snapping the opening of the c-clip directly onto the grip, making it a simple and convenient way to fasten or unfasten the visual aid and feedback device 400 from the grip of the golf club. Other fasteners may include but is not limited to, for example, hook and loop fasteners, retaining rings, straps, and clamps.

Figure 5:
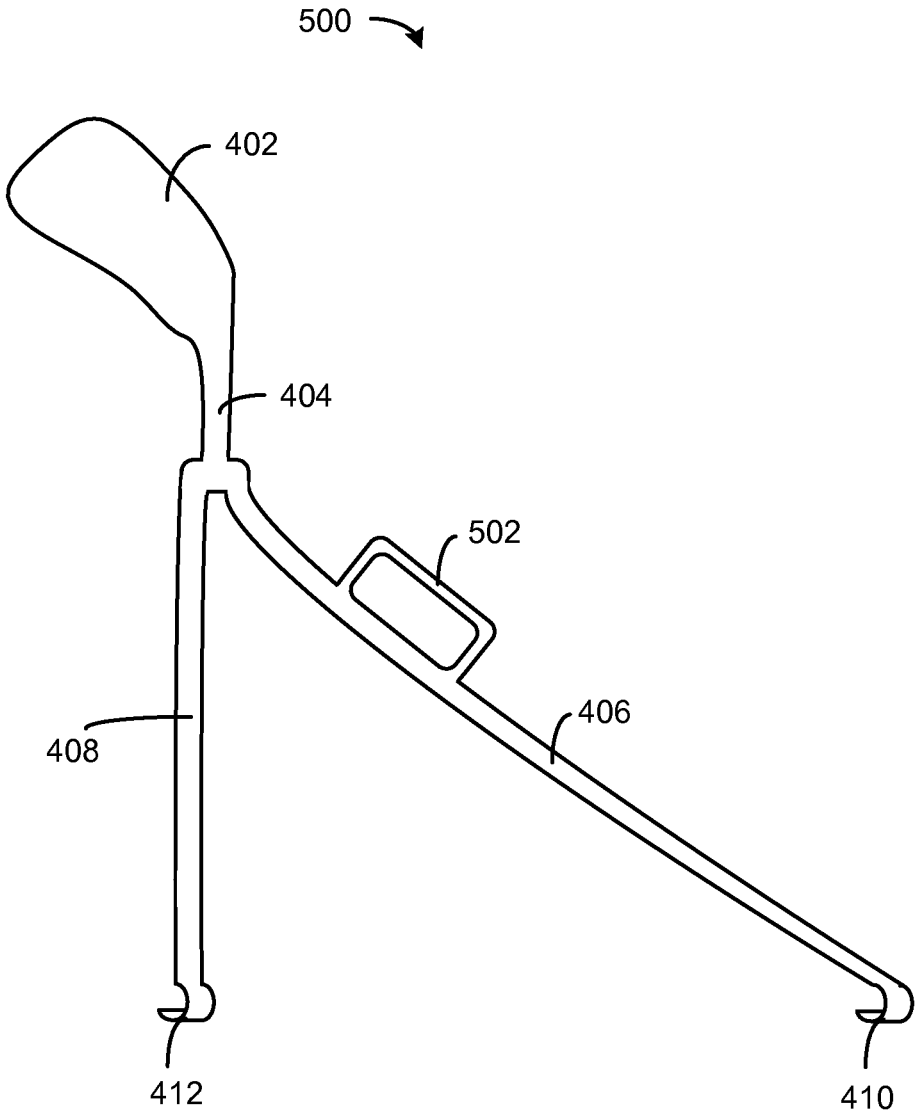
FIG. 5 illustrates a visual aid and feedback device having a sternum guide in accordance with an embodiment.

FIG. 5 illustrates a third embodiment of a visual aid and feedback device 500 which includes several elements of the second embodiment of the visual aid and feedback device 400 previously presented hereinabove. Similar components are designated with the same reference numerals described in the previous embodiment shown in FIG. 4. As illustrated in FIG. 5, a sternum guide 502 is formed as a rectangular structure at the outer portion of the first supporting member 406 and proximate to the neck 404 of the visual aid and feedback device 500. In practice, the sternum guide provides a second visual aid for the golfer and connection to a chest strap described later herein below. In addition, the sternum guide 502 may be integrated with the first supporting member 406 as a unitary structure or attached separately to the first supporting member 406 using c-clips, hook and loop fasteners, retaining rings, straps, and clamps.

Figure 6:
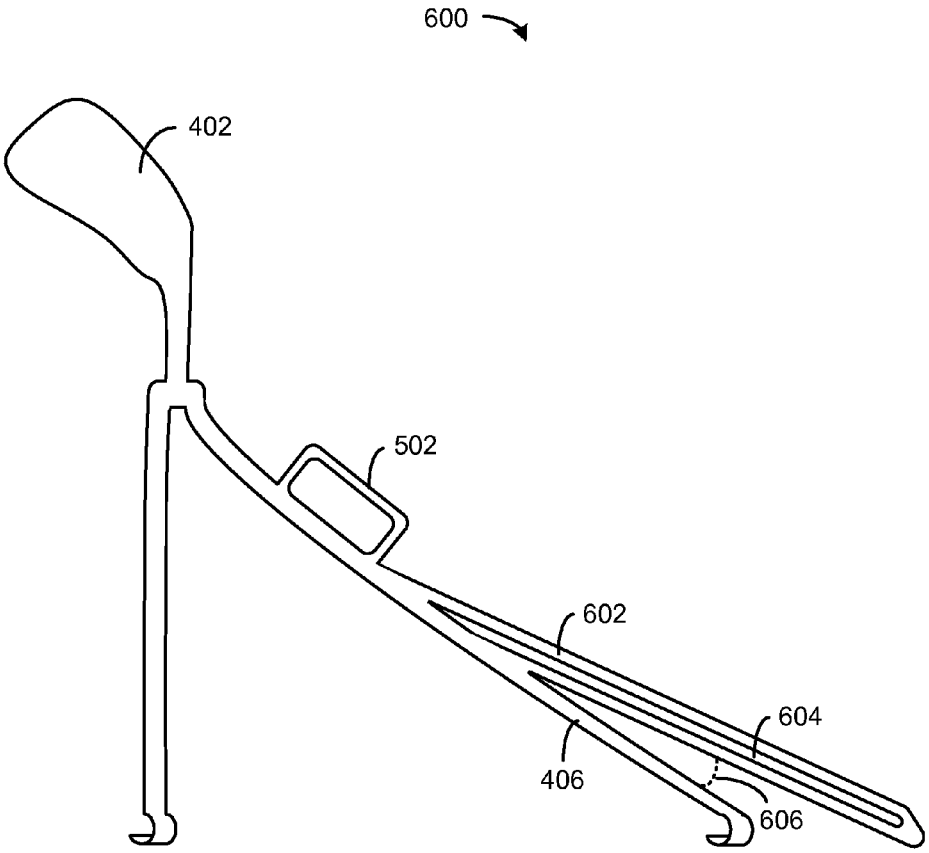
FIG. 6 illustrates a visual aid and feedback device having an elongated slanted wrist guide structure in accordance with an embodiment.

FIG. 6 illustrates a fourth embodiment of a visual aid and feedback device 600 which includes several components of the third embodiment of the visual aid and feedback device 500 previously presented hereinabove. In the fourth embodiment, the visual aid and feedback device 600 includes a wrist guide 602 that is formed on the first supporting member 406 and adjacent to the sternum guide 502 of the visual aid and feedback device 600. The wrist guide 602 includes an elongated slanted structure that forms a slot 604 that is parallel to the longitudinal side of the wrist guide 602. In addition, the wrist guide 602 is oriented in such a way that an acute angle 606 is formed between the wrist guide 602 and the first supporting member 406 as shown in FIG. 6. In practice, the wrist guide may provide tactile feedback to the golfer by making physical contact with the golfer's wrist. When the golfer performs a back swing, the wrist guide 602 may be used throughout the back swing to keep the club face square (in relation to swing) and the shaft of the golf club on plane. The wrist guide 602 provides tactile feedback and physical sensation on the inside forearm of the golfer's left arm for a right-handed golfer (or on the inside forearm of the golfer's right arm for left-handed golfers) to guide the golfer's golf club up the back swing on plane and ultimately keeping the face angle square. Thus, the golfer may use the tactile feedback and physical sensation from the wrist guide 602 on the golfer's forearm to set the correct position in the back swing.

Figure 7:
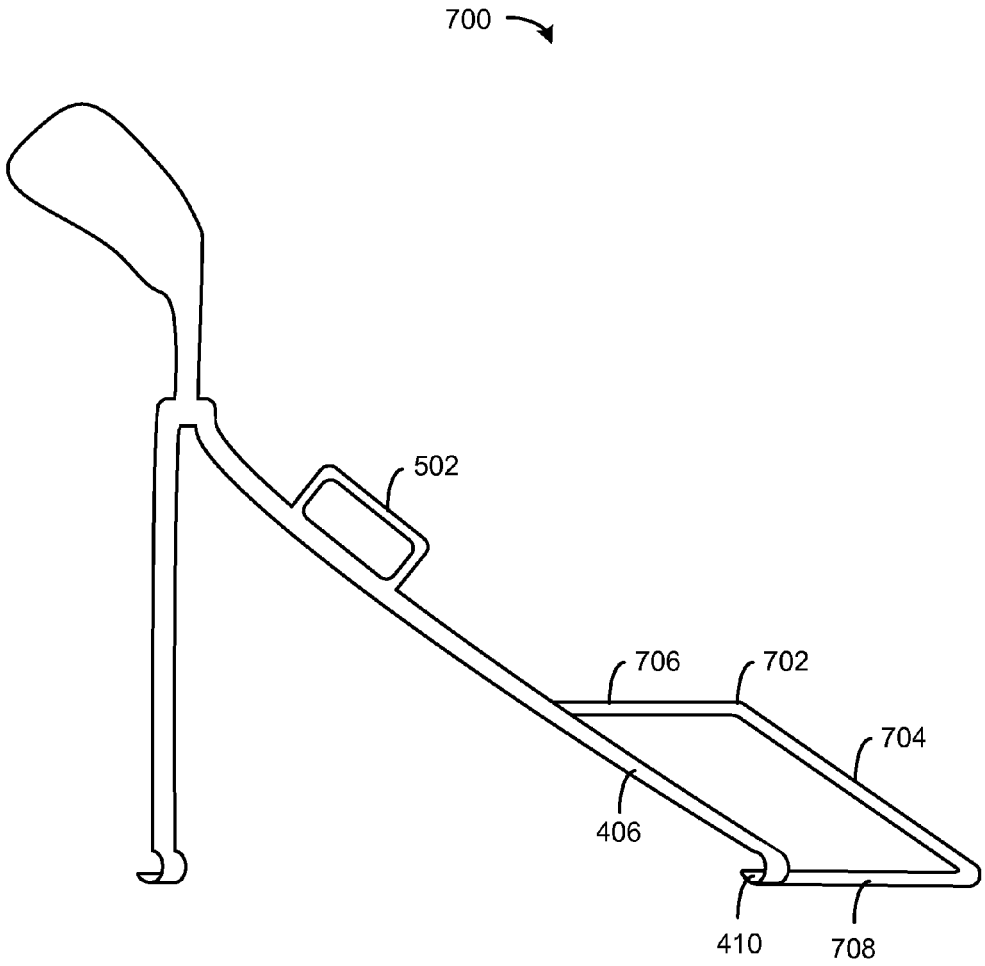
FIG. 7 illustrates a visual aid and feedback device having an extended slanted wrist guide structure in accordance with an embodiment.

FIG. 7 illustrates a fifth embodiment of a visual aid and feedback device 700. In this illustration, a modified wrist guide 702 is presented having similar elements as in the fourth embodiment. The wrist guide 702 includes an extended slanted structure the generally forms a parallelogram having a longitudinal member 704 that runs parallel to the first supporting member 406 and a first short side 706 coupling the first supporting member 406 and with the longitudinal member 704 and a second short side 708 coupling the c-clip 410 of the first supporting member 406 and with the longitudinal member 704. In one application, the parallelogram shaped wrist guide 702 may rest on the inside wrist of the golfer to ensure that the clubface stays in the correct position through the golfer's swing. For example, the wrist guide 702 may be used as a guide to keep the clubface square (in relation to swing) and the golf club shaft on plane. The wrist guide 702 may rest on the inside forearm of the golfer's left arm for right-handed golfers or on the inside forearm of the golfer's right arm for left-handed golfers.

Figure 8:
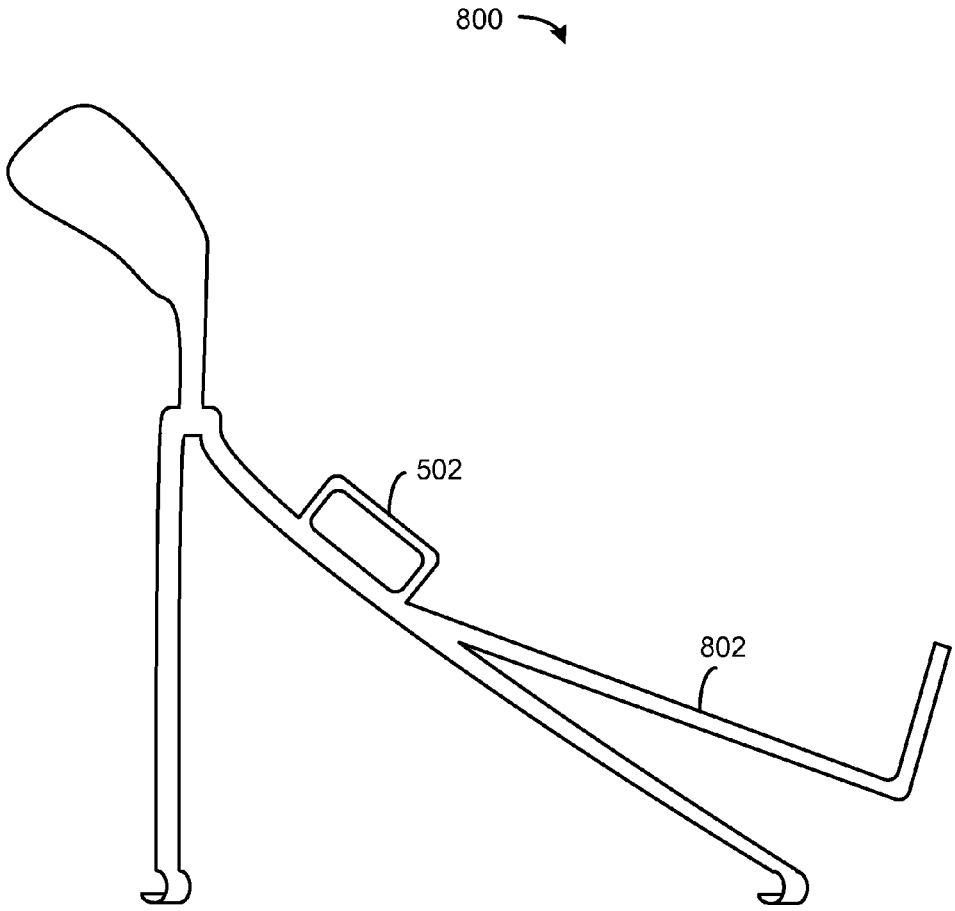
FIG. 8 illustrates a visual aid and feedback device having an L-shaped wrist guide design implementation in accordance with an embodiment.

FIG. 8 illustrates a sixth embodiment of a visual aid and feedback device 800 having an L-shaped wrist guide 802 design. The wrist guide 802 in this embodiment is in the form of an L-shaped structure that is adjacent to the sternum guide 502 of the visual aid and feedback device 800. In addition, the wrist guide 802 in this embodiment is designed to perform the same tactile feedback function as in the previous embodiments presented hereinabove. Although the above embodiments 600-800 present different wrist guide implementations, these embodiments are merely illustrative and may include other designs which perform the same tactile feedback function to the golfer. In addition, elements of the visual aid and feedback devices 600-800 may be formed as a unitary structure using the injection molding processes described hereinabove or as separate elements which may easily attachable and detachable from the visual aid and feedback devices 600-800.

Although the visual aid and feedback devices 600-800 is generally configured for right-handed golfers, a mirrored configuration (not shown) of the visual aid and feedback device may be used to support left-handed golfers. The structural elements, application and use of the mirrored configuration are similar to the embodiments of the visual aid and feedback devices 600-800 described hereinabove.

Figure 9:
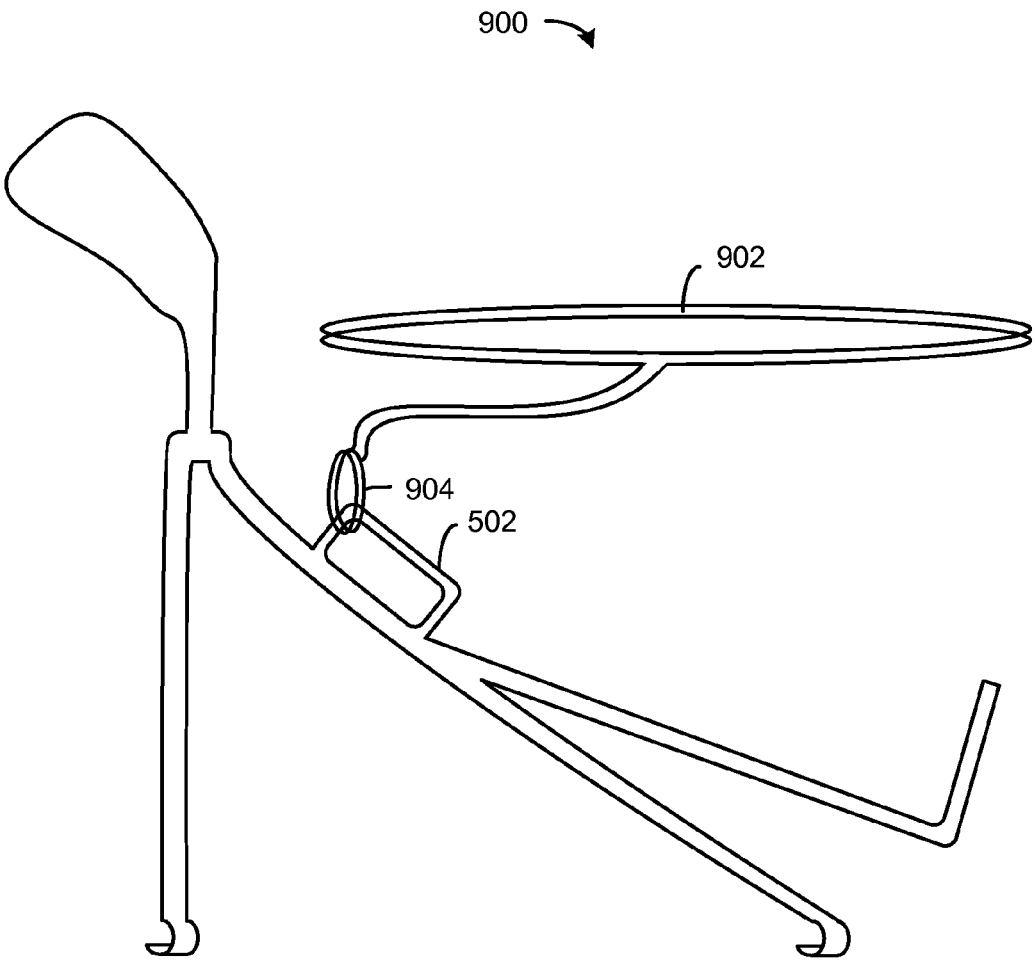
FIG. 9 illustrates a visual aid and feedback device having a chest strap attachment in accordance with an embodiment.

FIG. 9 illustrates a seventh embodiment of a visual aid and feedback device 900. This embodiment includes similar structural elements as described in the sixth embodiment. In addition to these elements, the visual aid and feedback device 900 may include a chest strap 902 which is connected to the sternum guide 502 via a detachable clip 904 such as, for example, a snap hook, a carabiner clip, a d-ring clip, or other similar removable fasteners. The chest strap 902 may be formed from light weight, durable, and elastic material such as rubber, neoprene, and natural or artificial elastic ropes. A golfer may use the chest strap 902 to support the visual aid and feedback device 900 during use and positioning of the device. In addition, the chest strap 902 may serve as a second reference for providing a visual guide to promote a one piece take away. As visual guide, the chest strap 902 may also assist the golfer in keeping the golf club in front of the golfer's body. Moreover, by keeping tension in the strap, the chest strap 902 may also promote width in the golf swing. In practice, the chest strap 902 may be attached around the golfer's body thereby forcing the body to work as one unit with the visual aid and feedback device 900.

Figure 10:
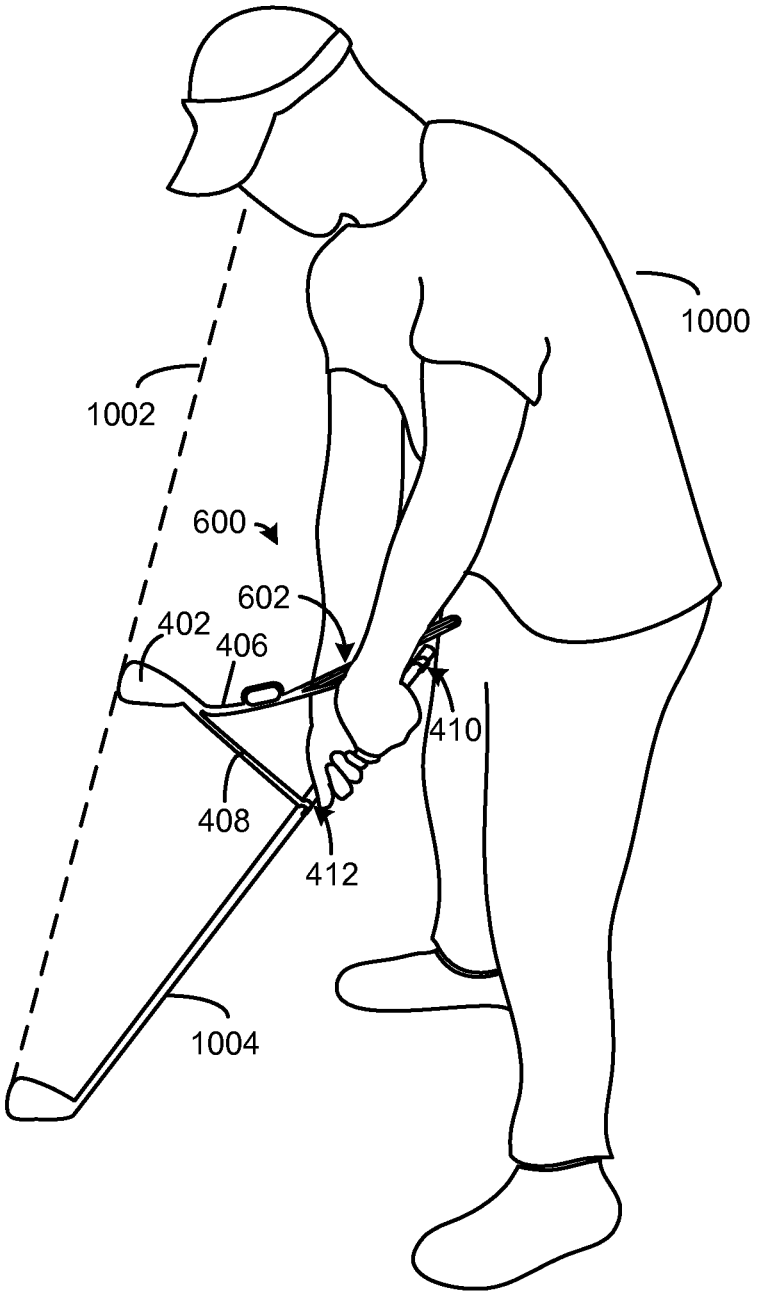
FIG. 10 illustrates a side view of a golfer implementing the visual aid and feedback device of FIG. 6 by attaching it to a golf club.

FIG. 10 illustrates a side view of a golfer 1000 at address position implementing the visual aid and feedback device 600 of FIG. 6 by attaching it to the grip of a golf club 1004 using c-clip 410 and c-clip 412. FIG. 10 further illustrates the proper method of holding the visual aid and feedback device 400 by the golfer. In this illustration, the golfer grips the golf club in between the opening formed by the first supporting member 406 and the second supporting member 408 of the visual aid and feedback device 600 without interfering with the golfer's swing. Note that the visual aid and feedback device 600 is positioned so that it splits the middle of right and left forearms of the golfer 1000. In addition, the golfer 1000 may position the visual aid and feedback device 600 so that the clubface reference head 402 is aligned to the clubface of the golf club 1004. In other words, by using the visual aid and feedback device 400, the golfer may visually line up (at dotted line 1002) the clubface reference head 402 with the clubface of the golf club 1004. Once aligned, the visual aid and feedback device 400 provides a visual reference of the clubface which may be used to set up the proper grip orientation. In practice, the clubface reference head 402 on the visual aid and feedback device 400 matches the clubface on the actual golf club throughout the golfer's swing.

FIG. 10 further illustrates the proper positioning of the wrist guide 602 relative to the golfer's forearms. The wrist guide, in this example, is firmly pressed against the golfer's forearm, providing tactile feedback and physical sensation to the golfer 1000. Subsequently, this feedback may be used by the golfer 1000 to set the correct position in the back swing.

Referring again to FIG. 10, at address position, the golfer positions the visual aid and feedback device 600 so that it splits the middle of the right and left forearms of the golfer.

Figure 11:
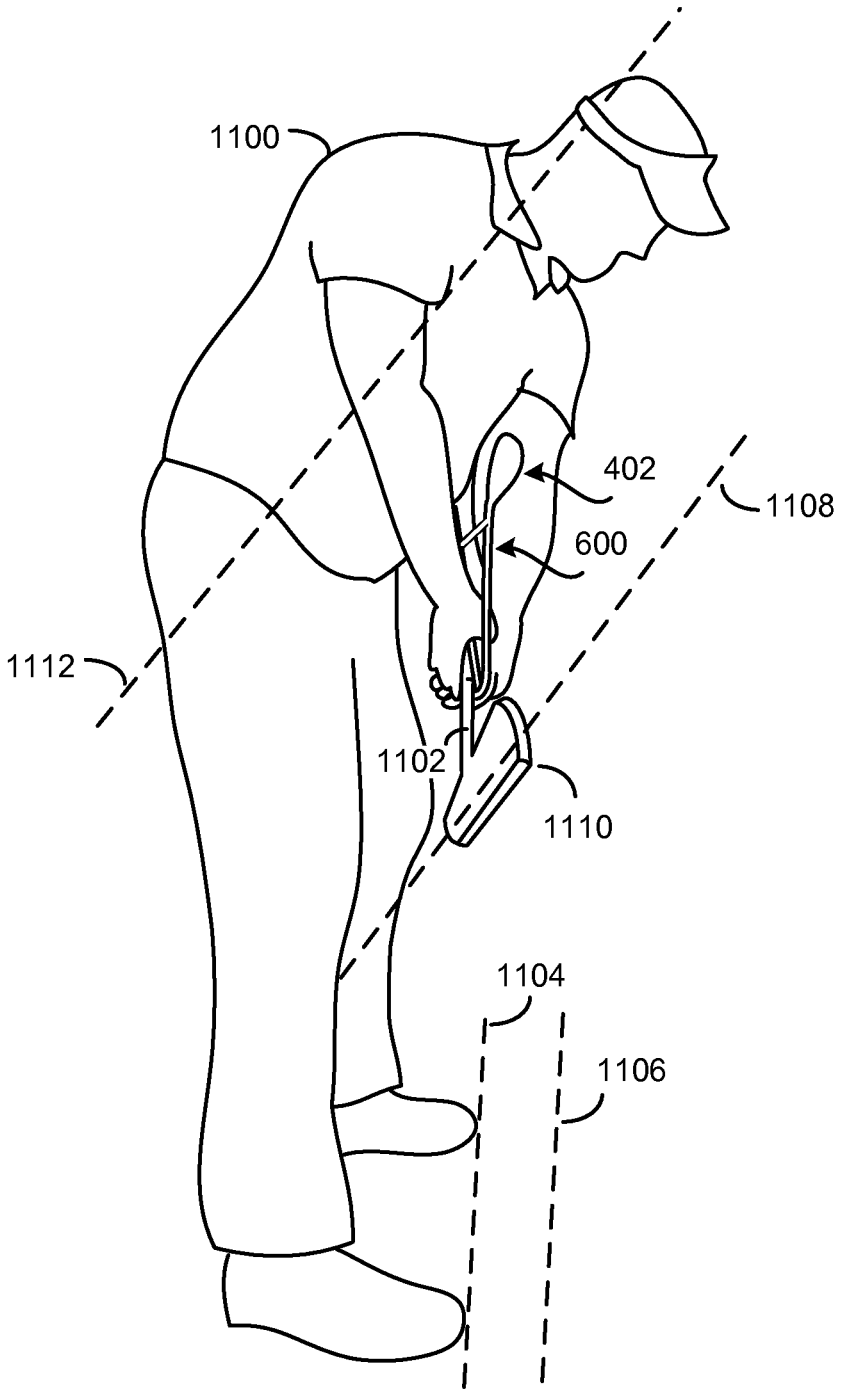
FIG. 11 illustrates a golfer's stance and proper grip of a golf club at a take away position.
Figure 12:
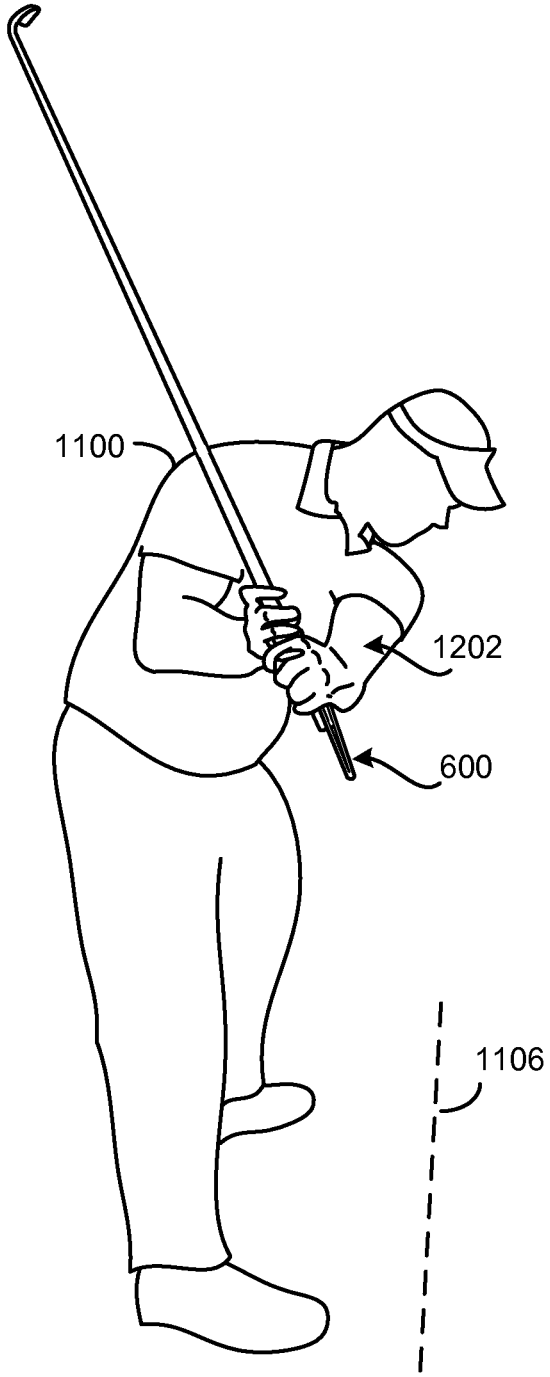
FIG. 12 illustrates a golfer's stance and proper grip of a golf club at a mid-swing position.
Figure 13:
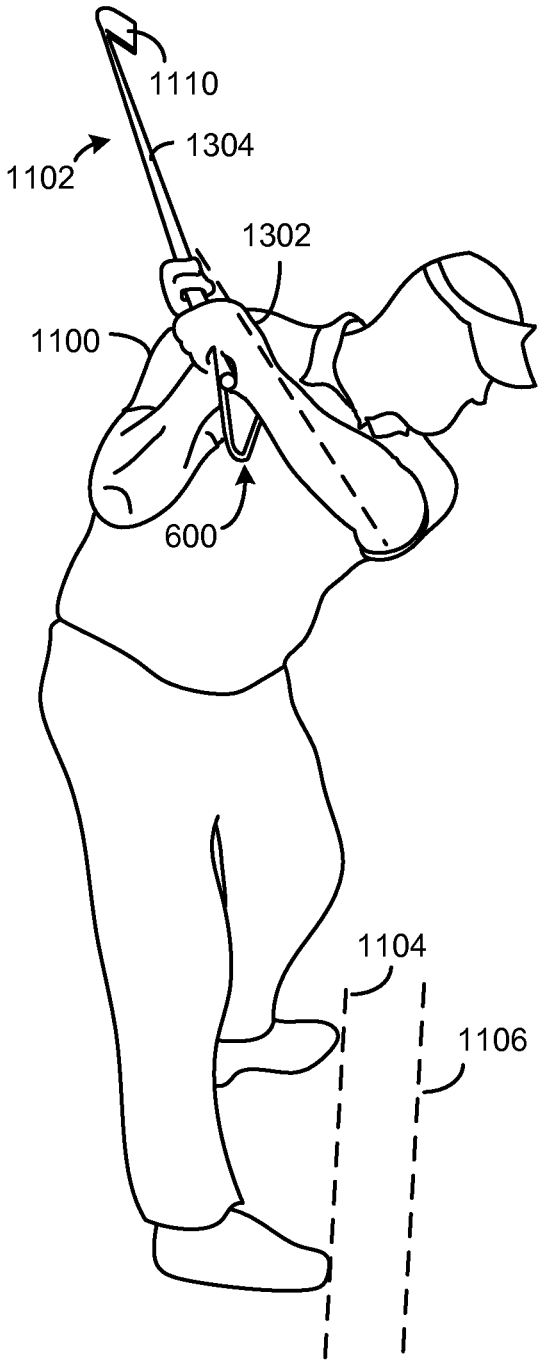
FIG. 13 illustrates a golfer's stance and proper grip of a golf club at a back swing position.

FIGS. 11-13 illustrate various positions and use of the visual aid and feedback device 600 at different golf swing positions by a golfer 1100.

FIG. 11, for example, illustrates a stance and proper grip of a golf club 1102 of a golfer 1100 at a take away position. At take away, the golf club 1102 is positioned so that it is generally parallel to the ground. A shaft angle (not shown) is generally on the toe line 1104 parallel to the ball line 1106 while the clubface angle 1108 of the clubface 1110 is generally parallel to the spine angle 1112. The visual aid and feedback device 600 is position between the golfer's left and right forearms with the clubface reference head 402 pointed upward toward the golfer's head.

FIG. 12 illustrates the proper positioning of the golfer's left arm 1202 which is shown parallel to the ground at mid swing. The shaft angle (not shown) is generally pointing to the ball line 1106. The visual aid and feedback device 600 may be braced up against the left inside part of the forearm 1202 of the golfer. The golfer's hands are generally in the center of the golfer's chest and the right wrist is fully hinged at this point of the golf swing.

FIG. 13 illustrates the top of a back swing of the golfer 1100. The left wrist 1302 (if using a conventional grip) of the golfer 1100 should be flat. At the top of the back swing the golf club 1102 should be at most parallel to the ground (not past parallel) and the shaft 1304 should be parallel to the ball line 1106 and toe line 1104. At back swing, the visual aid and feedback device 600 is still positioned between the golfer's left and right forearms with the clubface reference head 402 pointed upward toward the golfer's chest. It should be noted that although FIGS. 10-13 illustrates various golf swings using the embodiment of the visual aid and feedback device 600, the visual aid and feedback device embodiments 400, 500, and 700 described hereinabove are also applicable and may be used in the different golf swings presented in FIGS. 10-13.

The visual aid and feedback device described hereinabove may also include but is not limited to mechanical, chemical, electrical or wireless feedback mechanisms to enhance the visual quality or tactile feedback. This may include, for example, LED lights, fluorescent strips or paint, vibrational feedback mechanisms, and surface enhancing materials and agents.

As used in the specification and the appended claims, the singular forms "a", "an", and "the" included plural referents unless the context clearly dictates otherwise.

All patents, patent applications, and other references cited herein are incorporated by reference in their entireties.

It is noted that the foregoing disclosure has been provided merely for the purpose of explanation and is in no way to be construed as limiting of the present invention. Although the present invention has been shown and described with respect to several preferred embodiments thereof, various changes, omissions, and additions to the form and detail thereof, may be made therein, without departing from the spirit and scope of the invention. It is understood that the words which have been used herein are words of description and illustration, rather than words of limitation. Changes may be made, within the purview of the appended claims, as presently stated and as amended, without departing from the scope and spirit of the present invention in its aspects.

Other embodiments and modifications of the present invention may occur to those of ordinary skill in the art in view of these teachings. Accordingly, the invention is to be limited only by the following claims which include all other such embodiments and modifications when viewed in conjunction with the above specifications and accompanying drawings.

What is claimed is what is described and illustrated, including:

1. A golf club training aid device comprising:

a clubface reference head;

a first supporting member;

a second supporting member, wherein the first supporting member and the second supporting member are coupled to the clubface reference head by a narrow connector; and a third supporting member, wherein the second supporting member is coupled to the third supporting member forming a substantially acute angle, and wherein the first supporting member is coupled to the third supporting member forming a substantially perpendicular angle.

2. A golf club training aid device comprising:

a clubface reference head;

a first supporting member having a first proximal end and a first distal end;

a second supporting member having a second proximal end and a second distal end, wherein the first proximal end of the first supporting member and the second proximal end of the second supporting member are coupled to the clubface reference head by a narrow connector, wherein a substantially acute angle is formed between the first proximal end of the first supporting member and the second proximal end of the second supporting member;

a first fastener coupled to the first distal end of the first supporting member; and a second fastener coupled to the second distal end of the second supporting member.

3. The golf club training aid device of claim 2 wherein the golf club training aid device is attached to a golf club using the first and second fasteners.

4. The golf club training aid device of claim 2 wherein each fastener is a c-clip.

5. The golf club training aid device of claim 2 wherein the clubface reference head, first supporting member, second supporting member, and first and second fasteners are formed as a unitary structure.

6. The golf club training aid device of claim 2 wherein the clubface reference head defines a first visual aid.

7. The golf club training aid device of claim 2 further comprising a sternum guide coupled to the first supporting member.

8. The golf club training aid device of claim 7 further comprising a wrist guide coupled to the first supporting member and adjacent to the sternum guide.

9. The golf club training aid device of claim 8 wherein the wrist guide directs a clubface of the golf club to maintain a fixed position.

10. The golf club training aid device of claim 9 wherein a chest strap is coupled to the sternum guide.

11. The golf club training aid device of claim 9 wherein the sternum guide defines a second visual aid.

12. The golf club training aid device of claim 9 wherein the wrist guide comprises an elongated slanted structure.

13. The golf club training aid device of claim 9 wherein the wrist guide comprises an extended slanted structure.

14. The golf club training aid device of claim 13 wherein the extended slanted structure is coupled to the first supporting member at a first end of the extended slanted structure and coupled to the first fastener at a second end of the extended slanted structure.

15. The golf club training aid device of claim 9 wherein the wrist guide comprises an L-shaped structure.

16. The golf club training aid device of claim 9 wherein the clubface reference head is coupled to the narrow connector by a fastener.

17. The golf club training aid device of claim 16 wherein the clubface reference head having a detachable fastener detachably connected to the narrow connector.

* * * * *